United States Patent [19]

Hull et al.

[11] Patent Number: 4,966,400

[45] Date of Patent: Oct. 30, 1990

[54] DEVICE FOR REMOVAL OF ANIMAL DROPPINGS AND DEBRIS

[76] Inventors: Harold L. Hull, 401 Canyon Way, SP 43, Spanks, Nev. 89434; Alan Gross, 3445 Rocky Ridge Blvd., Spanks, Nev. 89431

[21] Appl. No.: 373,193

[22] Filed: Jun. 29, 1989

[51] Int. Cl.[5] ..... A01K 29/00; C01H 1/12

[52] U.S. Cl. ..... 294/1.4; 15/79.1; 56/400.02; 56/400.13; 414/440

[58] Field of Search ..... 294/1.4, 19.1, 19.2, 294/55; 15/41 R, 79 R, 79 A, 82, 83, 85, 104.8, 257.1–257.3, 257.6, 257.7; 56/328.1, 400.01–400.04, 400.11, 400.13; 171/63; 414/437, 439, 440

[56] References Cited

U.S. PATENT DOCUMENTS

| | | | |
|---|---|---|---|
| 425,695 | 4/1890 | Pontious | 56/400.13 |
| 501,430 | 7/1893 | Knight | 56/400.13 |
| 902,187 | 10/1908 | Warrenfeltz | 56/400.02 |
| 1,471,929 | 10/1923 | Todd | 56/400.13 |
| 1,580,600 | 4/1926 | Holbrook | 15/83 X |
| 2,484,437 | 10/1949 | Wells | 414/440 |
| 2,525,090 | 10/1950 | Bott | 15/83 X |
| 3,478,500 | 11/1969 | Rhoads | 56/400.02 X |
| 3,959,922 | 6/1976 | Leistikow | 15/79 R X |
| 4,641,873 | 2/1987 | Nurnberger | 294/1.4 |
| 4,765,666 | 8/1988 | Parks | 294/1.4 |

FOREIGN PATENT DOCUMENTS

| | | | |
|---|---|---|---|
| 973993 | 11/1964 | United Kingdom | 56/400.02 |

*Primary Examiner*—Johnny D. Cherry

[57] ABSTRACT

A wheeled apparatus with a telescopic handle for collecting and disposing of animal waste and debirs which may be operated by one hand by simply pushing the apparatus over the animal waste or debris. The apparatus rakes the animal waste and debris into a pile and then a striker slings it into a throw-away container such as a card-board milk carton for disposal.

2 Claims, 2 Drawing Sheets

FIG 4
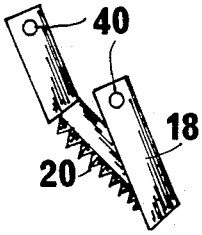
FIG 5
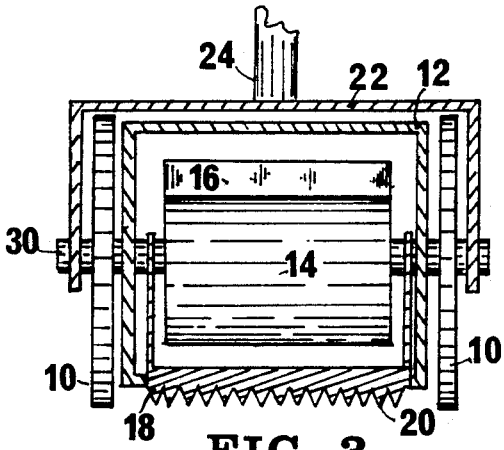
FIG 3
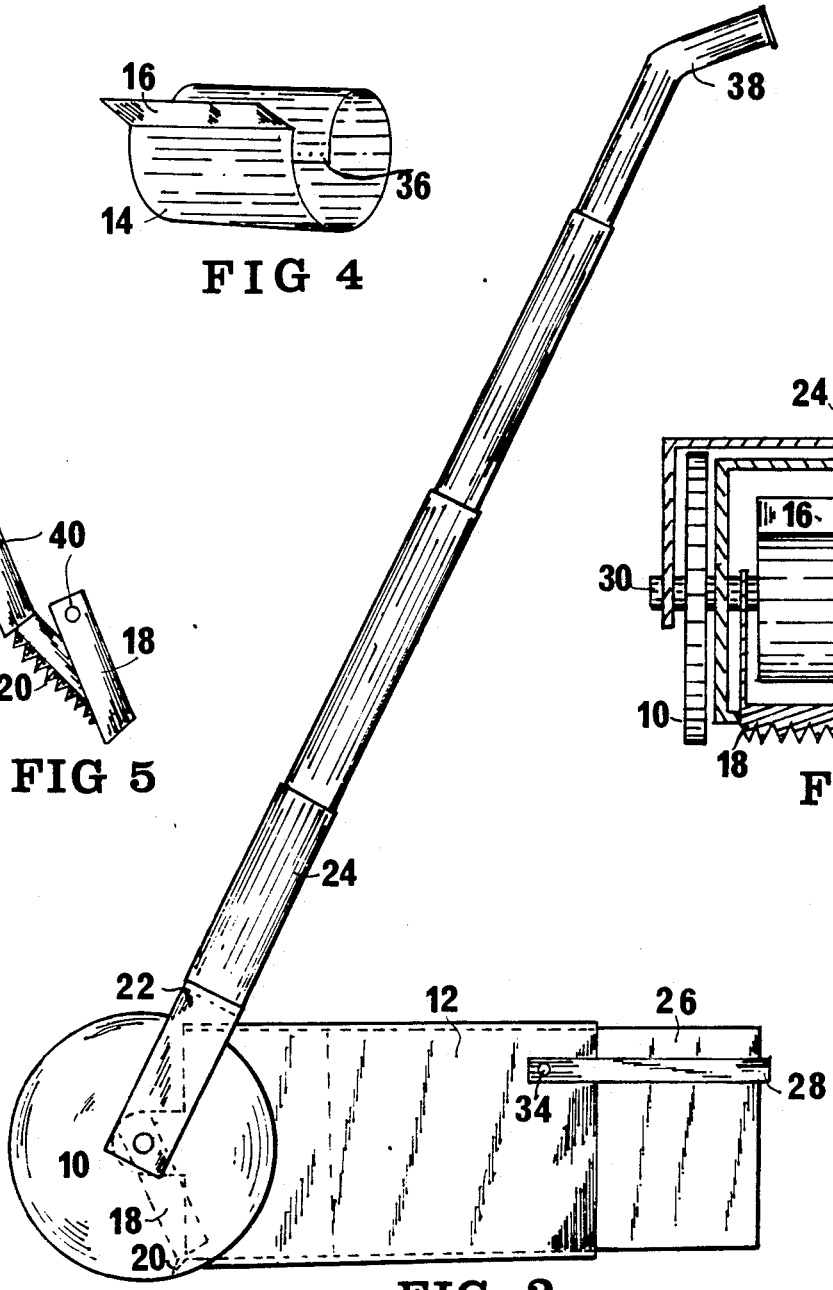
FIG 2
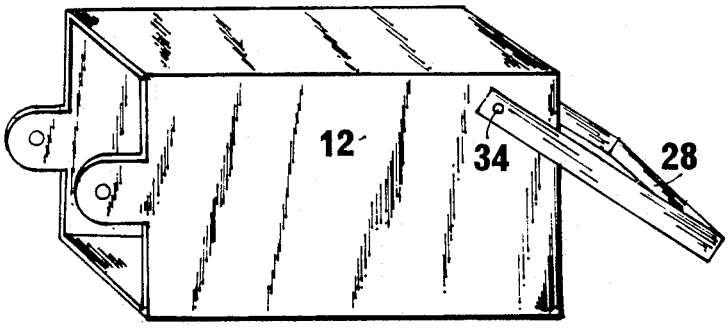
FIG 6

DEVICE FOR REMOVAL OF ANIMAL DROPPINGS AND DEBRIS

BACKGROUND OF THE INVENTION

This invention relates generally to collecting devices and more specifically to an apparatus for removing animal faces and other small objects from a lawn or other surfaces.

Numerous collecting devices have been proposed in the prior art that are adapted to pick up droppings of dogs, cats, and the like. For example U.S. Pat. Nos. 4,641,873, 4,741,566, and 4,042,269 are all illustrative of such prior art.

Prior art, among other means, proposes either a two handed means such as a shovel and a rake, a wheeled vehicle with an electric motor for moving sweeping means or various scraping means of raking the feces or debris into some type of container.

Many of the proposed devices are bulky, heavy and uncomfortable to carry when walking a dog in the park or along a street where laws now in force in many cities enforce the law that makes it mandatory for the dog owner to pick up and dispose of the animal droppings.

SUMMARY OF THE INVENTION

The present invention is a simple device mounted on two wheels that by pushing the apparatus over the feces or debris, rakes the feces debris forward, loosening it from the grass or other obstructions and then in one revolution of the wheels the special flat, helical spring device throws the feces or debris pass the raking means into a container such as milk carton for disposal.

A primary object of the present invention is to provide a simple device to collect, pick up and dispose of animal waste and other debris, that many be used one hand only, without any effort required on the part of the operator, other than pushing it over objects to be picked up.

Another object is to provide a simple apparatus that can be built with a minimum of parts.

Still another object is to provide a raking device cooperating with a collection device.

Yet another object is to provide a devcie that can use for it's collection device a disposable carton such as a milk carton.

Another object is to provide a device that can be used by an elderly person or an impaired person such as a one handed or arthritic person with limited use of their hands.

Still another object is to provide a device that requires no bending or stooping over by the operator.

Yet another object is to provide a collapsible or telescopic handle for easy storage or carrying.

Other objects and advantages will become apparent when considered in the light of the following description and drawings.

BRIEF DESCRIPTION OF THE DRAWINGS

FIG. 2 is a side view of the device.

FIG. 3 is a frontal view of the device.

FIG. 4 is a perspective view of the helical spring device that slings the feces or debris into the container.

FIG. 5 is a perspective view of the floating, pivoted raking device.

FIG. 6 is a perspective view of the chamber tube which holds the releasable container such as a milk carton.

DETAILED DESCRIPTION OF THE DRAWINGS

Figure 1:
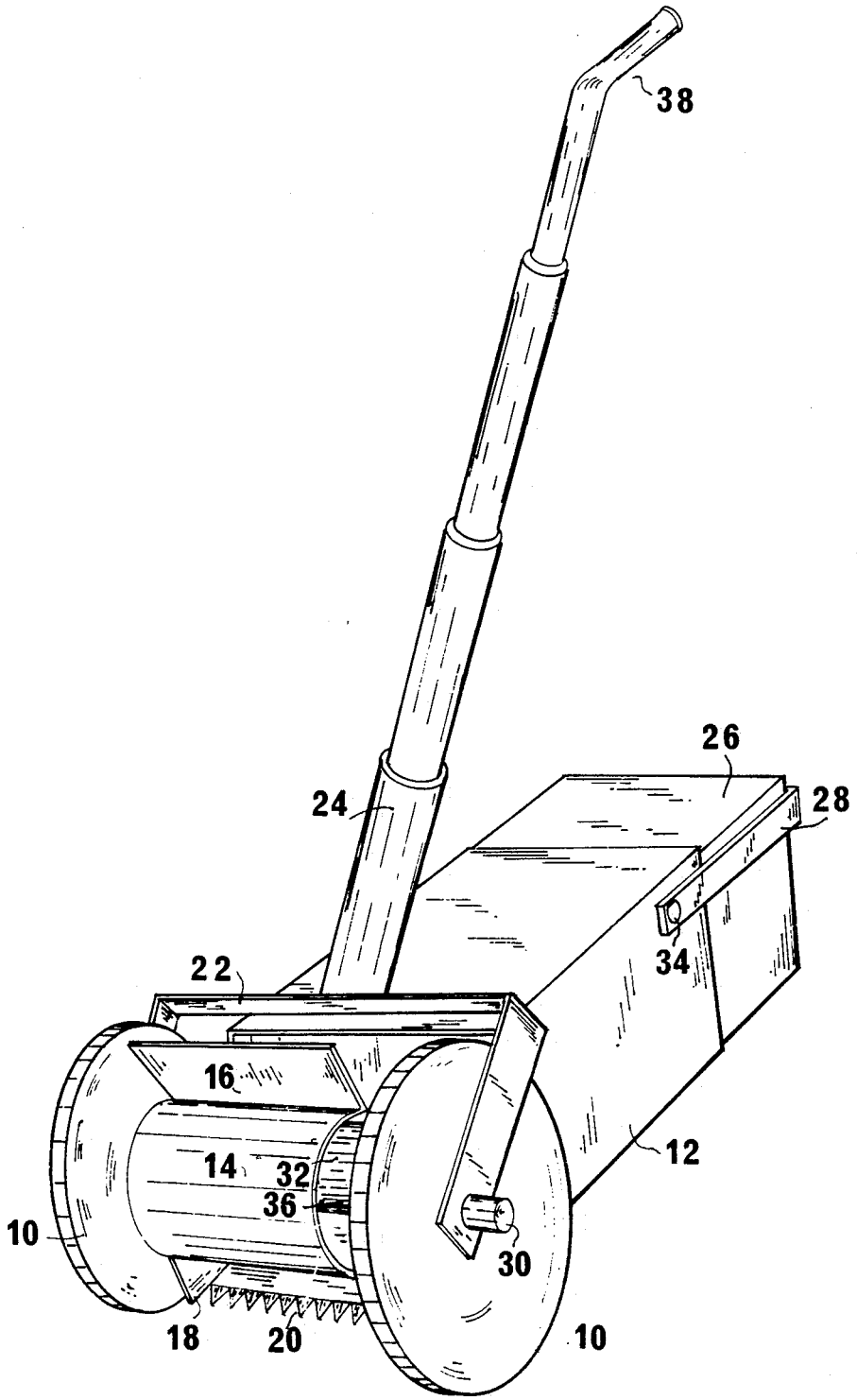
FIG. 1 is a perspective view of the device.

Turn now descriptively to the drawings, in which similar reference characters denote similar elements throughout the several views. The figures illustrate an apparatus for collecting and removing animal waste or debris in which 10 are wheels attached to a shaft 30, while 12 is a substantially square chamber to hold in place a disposable container and 14 is a helical coil spring mounted around shaft 30 with a right angle striker 16 at it outer end and attached at its inner end 32 to shaft 30 by mean of fasteners 36, while 18 is a floating rake, pivoted from shaft 30 at each of its ends 40, while 20 are teeth substantially at a 45 degree angle to the body of the floating rake 18, and 22 is substantially a U shaped forked frame to connect shaft 30 to telescoping handle 24, and 26 is a container open on the end contained in the chamber 12, such as a milk carton, with 28 being means to hold the container in place, 34 being means to mount and pivot the holding means 28, while 38 is a handle grip.

Now it will be seen that when the telescopic handle 24 is fully extended and the device, being held by it's handle 38, is pushed across a surface which contains animal feces or debris that the floating rake 18 with it's teeth 20 scrape the feces or debris into a loosened pile and as the wheels 10 continue to turn, scraping the feces or debris forward, that the spring 14 being attached to the shaft 30 by fasteners 36, revolves with the wheels 10 and shaft 30, thus bringing the right angle striker 16 in contact with the feces and as the spring 14 meets the resistance of the feces or debris it cocks the spring in a tensioned position until the force of the tension of the spring overcomes the resistance of the feces or debris and throws the feces in a backward motion pass the teeth 20 and raking means 18, into the chamber 34, which holds a container such as a milk carton or the like.

It will now be seen that the present invention overcomes the limitations of the prior art in that we have provided a simple device that can be operated with one hand only and requires the operator to simply push the device over the feces or debris and the feces or debris decomes raked together and thrown into the back of the container.

It will also be noted that the device can be easily carried by collapsing the telescopic handle and using the U shaped fork as a second handle for carrying, which allows the device to be so positioned as to have the container at the bottom which by gravity collects the feces at the bottom of the container.

It will also be noted that we have provided a device which lends itself to economical manufacturing as most of the parts may be injection molded and easily assembled.

It is also to be understood that we have so designed the device that the preferred embodiment will accept a standard milk carton which makes it economically feasible as generally milk cartons are thrown away.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for use in gathering and removing animal waste and other debris comprising: a handle, pivotable means to attach said handle to a shaft, said shaft having a wheel affixed to each of its ends, said shaft supporting a raking means, said shaft supporting a collection chamber, said shaft supporting a feces or debris striker means, said collection chamber supporting a releasable, disposable container, said striker means being a split, helically shaped tube having an inner and an outer edge, said tube having a memory, with the length of said tube being less than the inside dimensions of said collection chamber, means to fasten said inner edge of said tube to said shaft, said outer edge having a substantially right angle bend, said outer end forming said striker means, said handle, said shaft, said raking means, said collection chamber, said striker means and said releasable container cooperating together to collect and deposit said animal waste and other debris into said releasable container, when said wheels and said shaft are rotated.

2. The device of claim 1 in which said means to fasten said inner edge of said tube to said shaft are screws.

* * * * *